United States Patent [19]

Buhler

[11] 4,095,496

[45] Jun. 20, 1978

[54] STRIP HANDLING APPARATUS

[75] Inventor: Walter J. Buhler, Pearl River, N.Y.

[73] Assignee: National-Standard Company, Niles, Mich.

[21] Appl. No.: 714,516

[22] Filed: Aug. 16, 1976

[51] Int. Cl.[2] ..... B26D 7/06

[52] U.S. Cl. ..... 83/104; 83/106

[58] Field of Search ..... 83/27, 89, 94, 104, 83/106, 105; 144/242 G

[56] References Cited

U.S. PATENT DOCUMENTS

| | | | |
|---|---|---|---|
| 1,246,138 | 11/1917 | Mitchell | 144/242 G |
| 3,555,946 | 1/1971 | Addis | 83/104 |
| 3,861,259 | 1/1975 | Hitch | 83/106 |

*Primary Examiner*—Donald R. Schran

*Attorney, Agent, or Firm*—Emrich, Root, O'Keeffe & Lee

[57] ABSTRACT

The strip handling apparatus for use in conjunction with a scroll shear having a double set of cutting edges includes first, second and third chute assemblies mounted to the scroll shear and adapted to direct the cut strips of material onto a scroll shear piler having a stacker box. The first chute assembly includes a turn-over mechanism which rotates and turns over the cut strip material passing over the double set of cutting edges onto the scroll shear piler for stacking in the stacking box. The second chute assembly is adapted to direct the cut strip material falling between and through the double set of dies to the scroll shear piler and the third chute assembly is adapted to direct the butt-strip materials falling on the infeed side of the scroll shear to the scroll shear piler. A trim deflector mechanism selectively cooperates with the second and third chute assemblies to deflect the trim material to a waste collection station and to permit the through-the-die and butt-strip materials to pass onto the scroll shear piler for stacking in the stacking box. A timing control mechanisms for synchronizing the trimming and cutting of the strip material by the scroll shear, the operation of the turn-over mechanism, the butt strip stop and the trim deflector mechanism includes cams mounted to the cam shaft which cooperate with proximity switches to control each cycle of operation.

7 Claims, 6 Drawing Figures

STRIP HANDLING APPARATUS

BACKGROUND OF THE INVENTION

The present invention is directed to a strip handling apparatus for use in conjunction with a scroll shear having a double set of cutting edges.

Scroll shears having dies with a single set of cutting edges and dies with a double set of cutting edges are well known for manufacturing round ends for cylindrical containers. As is known in the art, a scroll shear having a single set of cutting edges produces a strip of material from which two rows of can ends may be produced and a scroll shear having a double set of cutting edges produces a strip of material from which a single row of can ends may be produced. The terms "over-the-die", "through-the-die" and "butt-strip" are terms well known in the art of manufacturing can ends. The term "over-the-die" means a cut strip of material falling on the scroll shear piler side of the scroll shear, that is, strip material passing over the double set of cutting edges and falling directly onto the scroll shear piler. The term "through-the-die" is used in describing the cut strip material which falls between or through the cutting edges of a scroll shear having a double set of cutting edges. The term "butt-strip" is used in describing a cut strip of material falling on the infeed side of the cutting edges of a scroll shear having a double set of cutting edges, and of necessity, is the last strip of material cut during the cutting of strips from a sheet of material.

When a sheet of material is cut by a scroll shear having a single set of cutting edges, all of the strips of material fall "over-the-die". In such an embodiment, the over-the-die cut strip of material is directed onto the scroll shear piler for stacking in a stacking box, as is well known in the art. However, when a sheet of material is cut by a scroll shear having a double set of cutting edges, some of the cut strips of material fall over-the-die, some fall through-the-die, and some, called butt-strips, fall on the infeed side of the scroll shear. In such a situation, conventional scroll shear piler devices cannot handle strips of material cut from dies having a double set of cutting edges since such devices can only handle strips of material that fall over-the-die. Accordingly, scroll shear pilers have been prevented from being used in conjunction with scroll shears having a double set of cutting edges. Thus, the manual labor required in positioning and stacking the various types of cut strip materials obtained from a scroll shear having a double set of cutting edges has limited the net production and increased the personnel required as compared to a scroll shear having a single set of cutting edges equipped with a conventional scroll shear piler.

SUMMARY OF THE INVENTION

It is an object of the present invention to provide a strip handling apparatus for use in conjunction with a scroll shear having a double set of cutting edges.

It is another object of the present invention to provide an automatic strip handling apparatus which is simple in construction and reliable in operation.

It is a further object of the present invention to provide a strip handling apparatus for use with a scroll shear having a double set of cutting edges which includes a turn-over mechanism to provide proper stacking of the cut strips of material.

It is still a further object of the present invention to provide a control mechanism for the timing of the scroll shear having a double set of cutting edges and the strip handling apparatus to provide proper stacking of the cut strips of material.

In a preferred embodiment of the present invention, the scroll shear includes a die having a double set of cutting edges. The strip handling apparatus useful in conjunction with such a scroll shear includes first, second and third chute assemblies mounted to the scroll shear and adapted to selectively direct the cut strips of material therefrom onto a scroll shear piler. The scroll shear piler includes a stacking box portion and a conveyor belt portion which cooperates with the first, second and third chute assemblies to direct and to stack the cut strips of material in the stacker box. The first chute assembly, mounted to the scroll shear on the out-feed side thereof, includes a strip turn-over mechanism which rotates to a point greater than the vertical point from the plane of the chute assembly to flip over the over-the-die cut strips of material onto the scroll shear piler conveyor belt portion for stacking in the stacking box portion.

The second chute assembly is mounted to the scroll shear between the double set of cutting edges to direct the through-the-die cut strips of material onto the scroll shear piler conveyor belt portion for stacking in the stacking box portion. A trim deflector mechanism is mounted on a frame means adjacent the end of the chute member opposite the end mounted to the scroll shear and is movable between a closed position blocking the path of the through-the-die trim cut strips of material on the chute assembly to cause the strips to fall to a scrap collection point and an open position wherein the through-the-die cut strips of material are directed onto the scroll shear piler conveyor belt portion for stacking. The third chute assembly is mounted on a frame means adjacent the scroll shear on the infeed side of the double set of cutting edges to direct the butt strips of material onto the scroll shear piler conveyor belt portion for stacking in the stacking box portion. The third chute assembly includes a stop finger mechanism mounted to the frame adjacent the scroll shear infeed side which mechanism selectively blocks the path of the third chute assembly to control the path of the butt strips down the third chute assembly. The trim deflector mechanism is positioned also on the frame means adjacent the end of the third chute assembly opposite the end mounted to the scroll shear to selectively cooperate therewith when in the closed position, if desired, to deflect the butt strips of material to a scrap collection point.

The control mechanism of the present invention includes cam means mounted on a shaft which rotates once for each sheet of material upon which the plurality of cutting operations is performed. Specifically, a plurality of cam elements are mounted to a shaft, associated with the infeed conveyor system and rotatable one revolution for each sheet of material die cut. Each of the cams is positioned to selectively engage a proximity switch which energizes a solenoid operated pneumatic valve to predeterminely control one of the three mechanisms associated and cooperating with the first, second and third chute assemblies. Thus, for example, the proximity switches selectively control the turn-over mechanism, and trim deflector mechanism and the stop finger mechanism.

DETAILED DESCRIPTION

Figure 1:
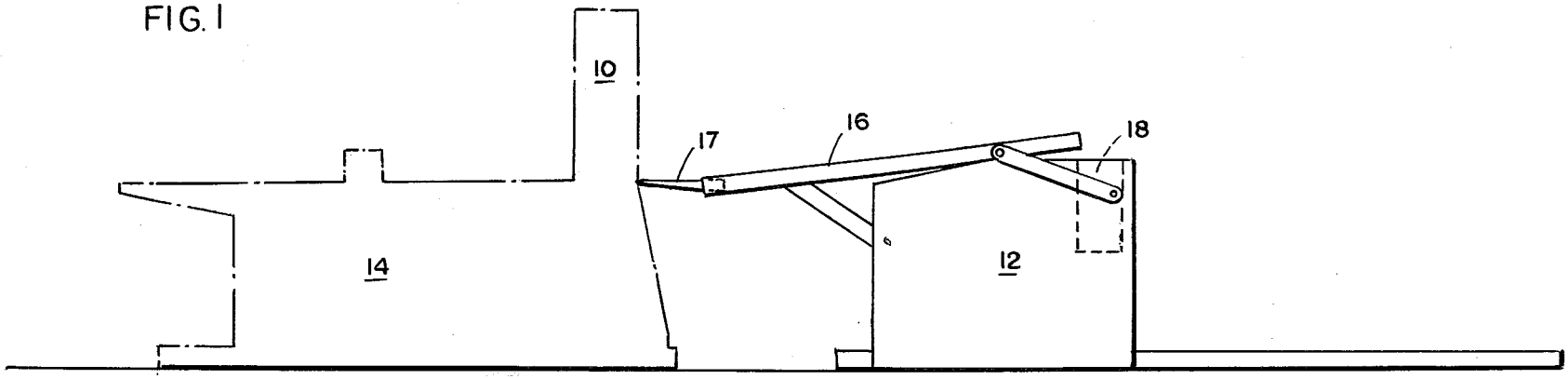
FIG. 1 is a schematic side elevation view of a scroll shear-scroll shear piler combination used for stacking over-the-die cut strips of material from a scroll shear having a single set of cutting edges.

Referring now to the drawings in greater detail, wherein like numerals have been used throughout the various views to designate similar parts, in FIG. 1 there is schmetically shown a view of a scroll shear assembly 10 in combination with a scroll shear piler apparatus 12, which combination is useful in cutting sheets of material (not shown) which are directed to the scroll shear assembly from an infeed assembly 14. The scroll shear assembly 10 includes a single set of cutting edges (not shown) which produce over-the-die cut strips of material which fall and are directed onto a conveyor belt member or means 16 having an end conveyor extension 17 thereon. The conveyor belt member 16 transports the over-the-die cut strips of material to stack the cut strips in the stacker box portion 18 of the scroll shear piler apparatus 12, as is well known in the art.

Figure 2:
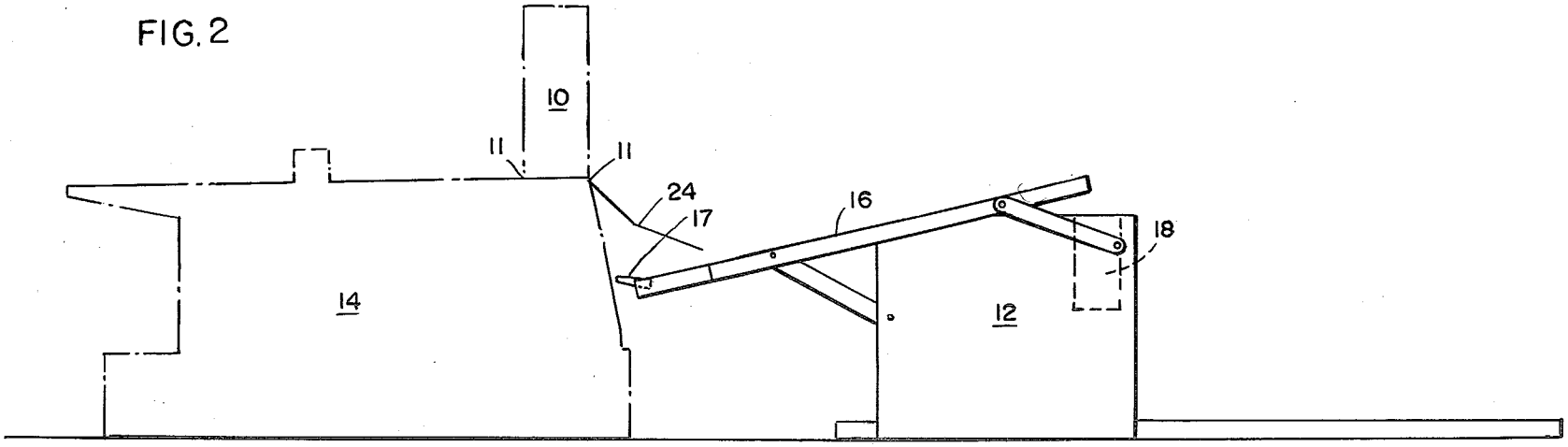
FIG. 2 is a schematic side elevation view of a scroll shear-scroll shear piler combination used for stacking cut strips of material from a scroll shear having a double set of cutting edges incorporating the strip handling apparatus in accordance with the present invention.
Figure 3:
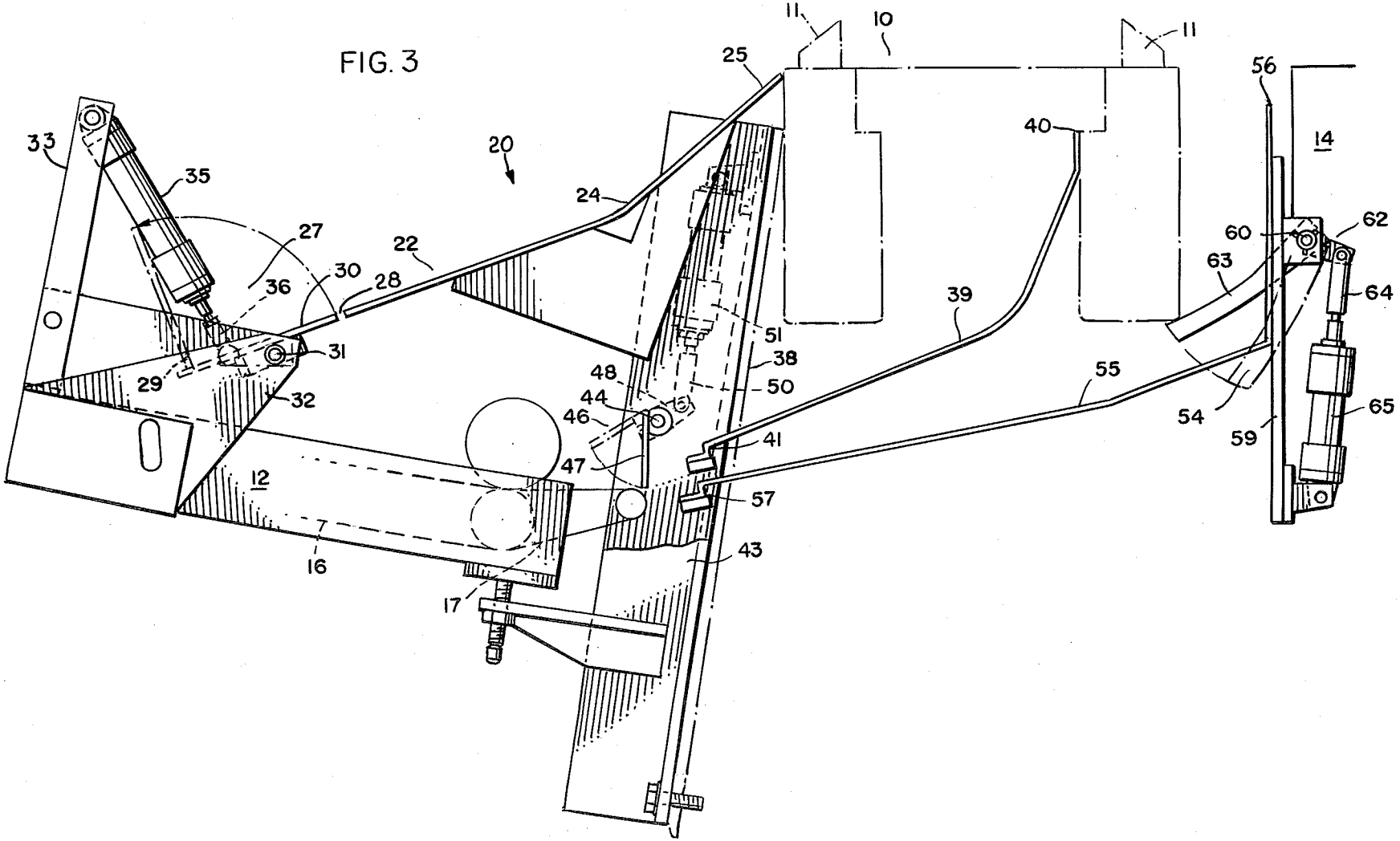
FIG. 3 is a sectional side elevational view showing the strip handling apparatus in accordance with the present invention.

When it is desired to incorporate a double set of cutting edges 11 (schematically shown in FIGS. 2 and 3) in the scroll shear assembly 10, the strip handling apparatus 20 (FIG. 3) of the present invention is necessary to provide control of the die cutting operation of each sheet of material and permit stacking of the cut strips of material into the stacker box portion 18.

The strip handling apparatus 20 includes a first chute assembly or means 22 having a chute member 24, mounted at its end 25 thereof to the outfeed side of scroll shear assembly 10, which is adapted to receive and direct the over-the-die cut strips of material onto the scroll shear piler apparatus 12. The first chute assembly 22 includes a turn-over mechanism or means 27 at the lower end 28 opposite end 25. The turn-over mechanism 27 includes a plate means 30 pivotally attached to a shaft 31 mounted to a main conveyor frame member 32. The plate means 30 includes a lip portion 29 on the end thereof which provides a retaining means for retaining the over-the-die cut strips of material on the plate means 30 above the scroll shear piler apparatus 12. First cylinder means 35 having a rod or ram means 36 is anchored to a frame extension 33, with the rod means 36 being attached to plate means 30. Thus, when the pneumatic cylinder 35 is actuated, the ram means 36 is pushed outwardly and the plate means is rotated in a counterclockwise direction about shaft 31 until the plate means 30 exceeds a point greater than the vertical from the plane of the chute member 24. Thus, when the over-the-die cut strips of materials slide down the chute member 24 and engage lip portion 29 and rest on the turn-over mechanism 27, the plate means 30 is rotated and the die cut strip of material is flipped over and drops onto the conveyor belt portion 16 of the scroll shear piler assembly 12 for stacking in the stacker box portion 18.

The strip handling apparatus 20 further includes a second chute assembly or means 38 having a chute member 39, mounted at its end 40 thereof to the scroll shear assembly 10 at a point between the double set of cutting edges 11, which is adapted to receive and direct the through-the-die cut strips of material onto the end of conveyor extension 17 of the scroll shear piler apparatus 12. The second chute assembly 38 includes a lower chute end portion 41 fixedly mounted to a second and third chute frame member 43. Pivotally mounted on shaft 44, mounted to the second and third chute frame member 43, and adjacent the lower chute end 41 is a trim deflector mechanism or means 46. The trim deflector mechanism 46 includes panel plate 47 and a bracket portion 48 which is engaged to rods or ram means 50 coupled to a second cylinder means 51 anchored to the second and third chute frame member 43. Thus, when the second cylinder means 51 is actuated, the ram means 50 is pushed outwardly and the trim deflector panel plate 47 is rotated in a clockwise direction about shaft 44 from a closed position, wherein the panel plate blocks the path of travel of the through-the-die cut strips of material onto the end conveyor extension 17 and causes the through-the-die cut strips to drop downwardly to a trim collection area, to an open position wherein the through-the-die cut strips drop onto the end conveyor extension.

The strip handling apparatus 20 further includes a third chute assembly or means 54 having a chute member 55 mounted at its end 56 thereof to a third chute frame member 59 positioned adjacent the infeed side of the double set of cutting edges 11 of scroll shear assembly 10 which chute assembly is adapted to receive and direct the butt die cut strips of material on to the end conveyor extension 17 of the scroll shear piler apparatus 12. The third chute assembly 54 includes a lower chute end portion 57 fixedly mounted to the second and third chute frame member 43 at a point below where the lower chute end portion 41 of the second chute assembly 38 is fixedly mounted thereto. The lower chute end portion 57 is positioned on the second and third chute frame member 43 such that the trim deflector panel plate 47 cooperates therewith when the trim deflector panel plate is in the closed position. When the second cylinder means 51 is actuated, the ram means 50 is pushed outwardly and the trim deflector panel plate 47 is rotated in a clockwise direction from the closed to open position to permit the butt-die cut strips of material to pass onto the end conveyor extension 17 wherein they are stacked on the stacker box portion 18.

The third chute assembly 54 includes a stop finger mechanism 62 mounted to a shaft 60 which is attached to the third chute frame member 59. The stop finger mechanism includes arms 63 which are moveable from an open position, wherein the butt-die cut strips of material are permitted to fall onto the third chute member 55, to a closed position wherein the arms 63 engage the scroll shear assembly 10 to block the path of the butt-die cut strips of material as they pass down the chute member 55. The stop finger mechanism 62 is connected to rod or ram means 64 incorporated with a third cylinder means 65, anchored to the third chute frame member 59. Thus, when the third cylinder means 65 is actuated and the ram means 64 is in the extended position, the arms 63 are in the open position. When the ram means 64 is retracted inwardly, the stop finger mechanism is rotated from the open position to a closed position wherein the arms 63 engage the scroll shear assembly to prevent and block the butt-die cut strips of material from passing down chute member 55.

Figure 4:
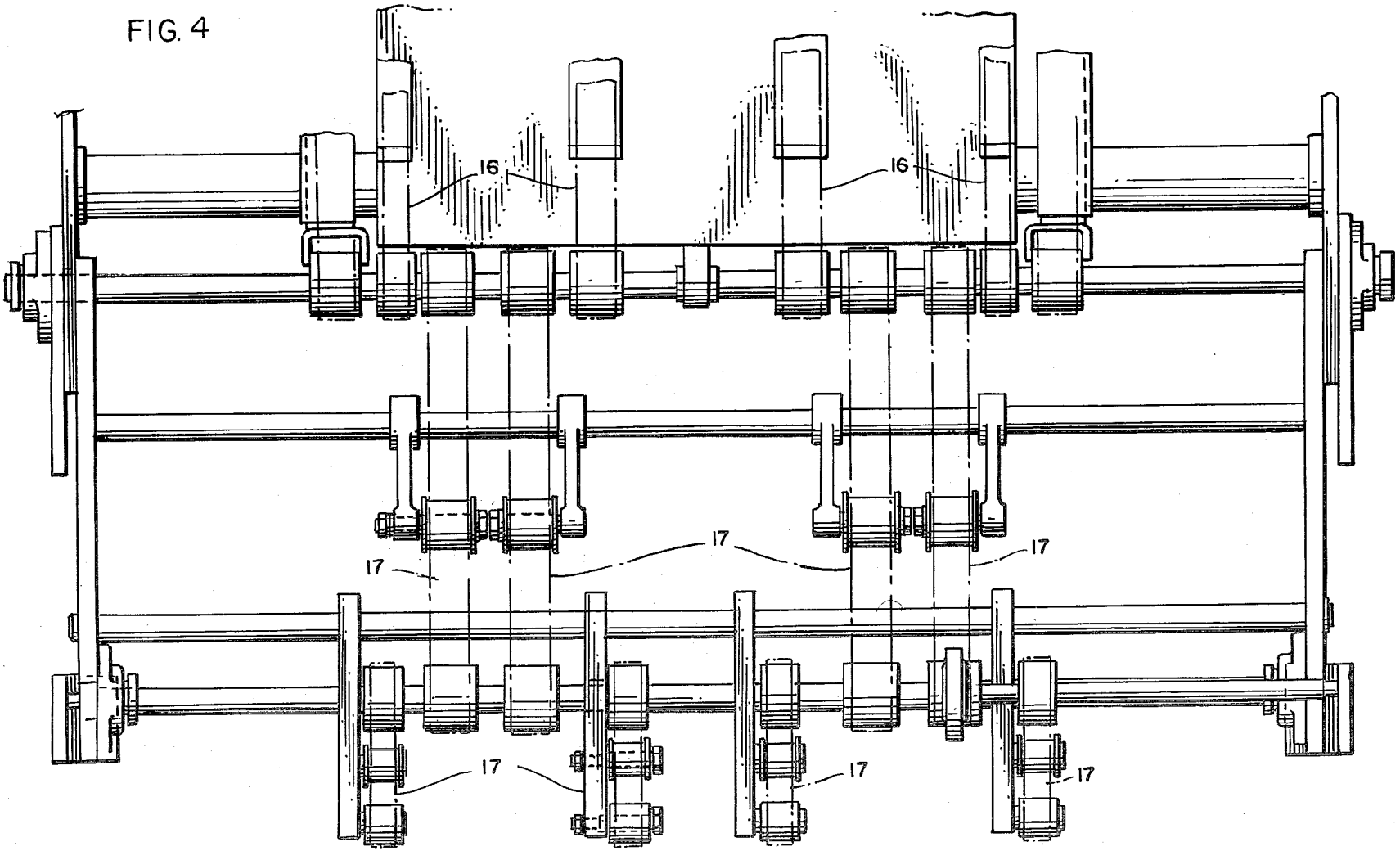
FIG. 4 is a top plan view of the scroll shear piler input conveyor portion of the scroll shear piler in accordance with the present invention.

For purposes of the present description, the novel strip handling apparatus herein described and illustrated is in a form particularly adapted for use with known scroll shear strip cutting and piling devices. For example, FIG. 4 illustrates a modified scroll shear apparatus 12 having a conveyor belt member or portion 16 and an end conveyor extension 17 thereon which is adapted to be positioned (See FIG. 3) below and adjacent chute member ends 41 and 57 to collect the through-the-die cut strips of material falling down chute member 39, and the butt-die cut strips of material, falling down chute member 55. Importantly, it is only necessary to modify existing scroll shear piler apparatus such that the conveyor belt portion 16 extends to a point wherein the through-the-die and butt-die cut strips of material land on the surface of the end conveyor extension for passage to and stacking in stacker box 18.

Figure 6:
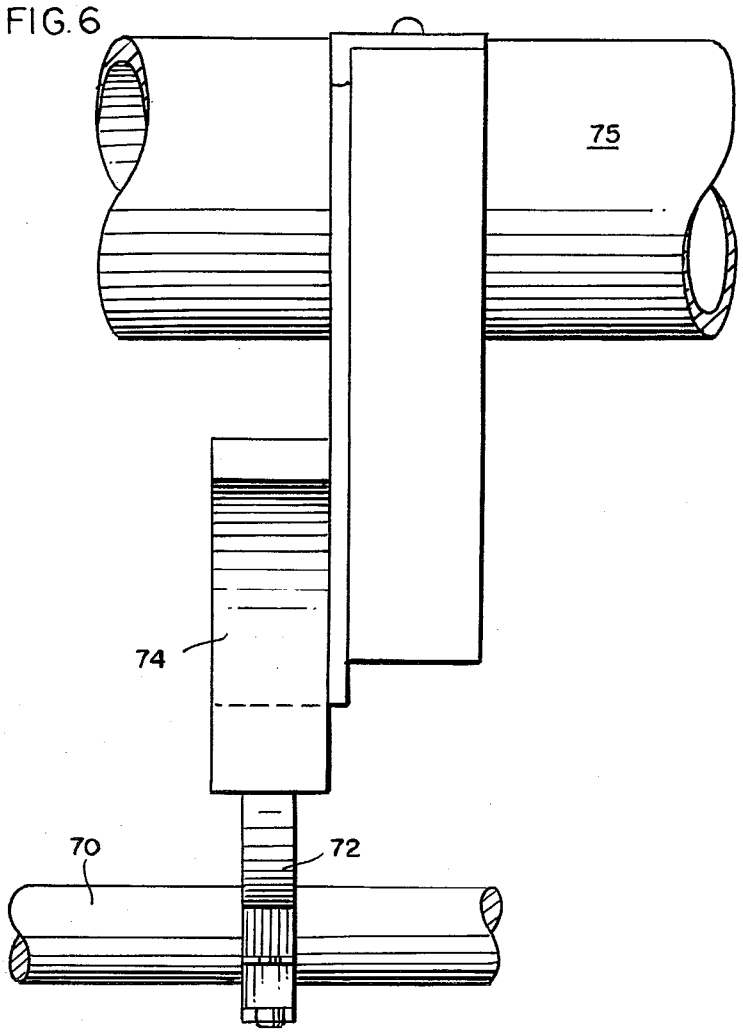
FIG. 6 is a partial front-elevational view of the control mechanism in accordance with the present invention.
Figure 5:
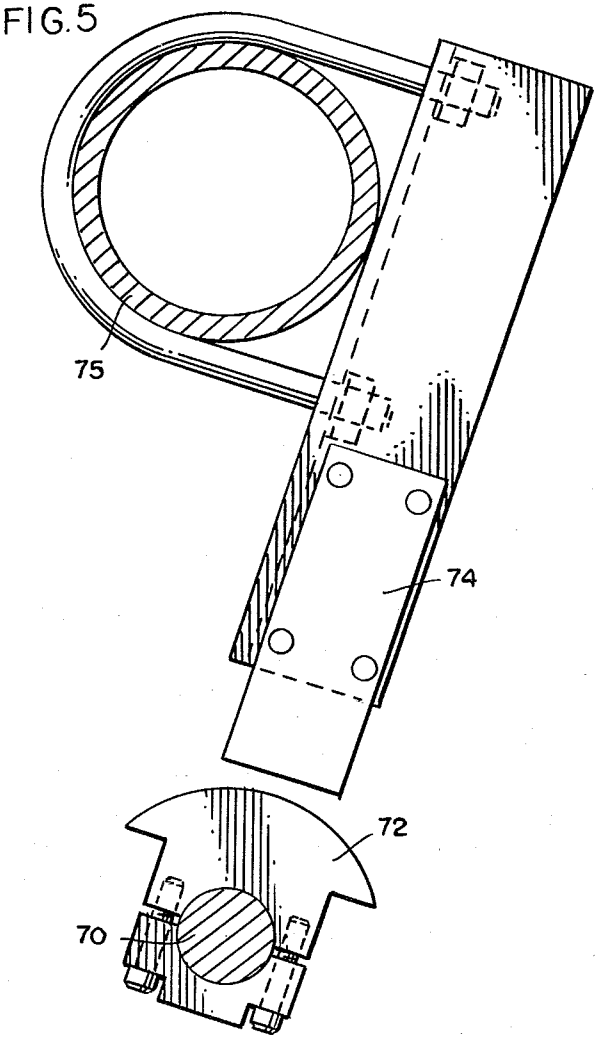
FIG. 5 is a cross-sectional view of the control mechanism in accordance with the present invention.

In FIGS. 5 and 6, a shaft 70, preferably the cam shaft of an automatic sheet feeder feeding sheets associated to the infeed assembly 14 of a scroll shear, which rotates once for each sheet of material that is die-cut using the scroll shear assembly 10 having a double set of cutting edges 11. Shaft 70 includes a plurality cams 72 (only one shown in FIGS. 5 and 6) predeterminely mounted thereon which are utilized in timing the operation of the scroll shear assembly and the three cylinder means 35, 51 and 65, as will hereinafter be described. Because the shaft 70 rotates one revolution per sheet of material passed into the scroll shear assembly, the rotation thereof causes the predeterminely mounted cams 72 thereon to selectively energize proximity switches 74 which are mounted to a frame member 75. The proximity switches 74 energize solenoids (not shown) which operate pneumatic valves (not shown) to control in predetermined relation with the operation of the scroll shear assembly, the three cylinder means 35, 51 and 65, which in turn actuate the turn-over mechanism 27, the trim deflector mechanism 46 and the stopfinger mechanism 62, respectively.

The essential element of the present invention is the timing of two of the die cuts of the sheet material, that is, the over-the-die and the butt-die cut strips of material in relation with each other and with the free falling through-the-die cut strips of material as they are sheared by the double set of cutting edges of the scroll shear assembly and pass down the inclined chutes 24, 39 and 55 to be positioned on the scroll shear piler apparatus for stacking in the stacker box. This timing is essential because when two of the three types of cut strips of material are sheared by a single stroke of the scroll shear assembly, it is not possible to control the approximate spacing between the strips going into the stacker box of the scroll shear piler apparatus without timing two of the three types of the strips of material. Thus, strips of material passing to the stacker box of the scroll shear piler apparatus without adequate spacing between the strips results in jams occuring at the stacker box.

To illustrate the timing of the present apparatus, the following example of the die cutting of a sheet of material wherein it is trimmed and cut into five strips utilizing three strokes of the scroll shear apparatus is described. A full cycle for trimming and cutting a single sheet equals 360°, from which it follows that there will be a stroke of the cutting edges every 120°. The trim material is first cut from the leading edge of the sheet of material and the succeeding cut sheets are numbered 1, 2, 3, 4 and "butt". The buttstrip is at the trailing edge of the sheet of material. Two cam means 72 are required for cylinder means 35, one cam means for the second cylinder means 51 and one cam means for the third cylinder means 65, because there is one trim cut, two over-the-die cuts and one butt-cut for each sheet of material. Also, there is a proximity switch 74 associated with each cam 72. When the shaft 70 is at zero degrees, the first operation of the scroll shear assembly 10 is to cut a piece of trim from the leading edge of the sheet of material on the first downward stroke of the scroll shear assembly. The trim cut falls through-the-die down chute 39 where it strikes the trim deflector panel plate 47 to be directed to the trim collection box. During this operation, cut strip 3 from a preceeding cutting operation which is already positioned on the turn-over mechanism 27, cylinder means 35 is actuated causing the turn-over mechanism to rotate to turned over cut strip 3 onto the conveyor belt member 16. When cylinder means 35 and the ram means 36 is fully extended, the ram means 36 is retracted thereby returning the turn-over plate means to its original position wherein it may receive the next over-the-die cut strip of material.

When the shaft 70 has rotated approximately 80 degrees, the ram means 50 of the second cylinder means 51 is extended outwardly thereby rotating the trim deflector panel plate 47 from the closed to the open position, out of the path of chutes 39 and 55, and the ram means 64 associated with the third cylinder means 65 extends swinging the butt stop fingers 63 away from the scroll shear assembly 10 to permit the butt strip, from the previous operation, to drop onto chute member 55 to pass down onto the conveyor extension 17. At approximately 120 degrees rotation of the cam shaft 70, the scroll shear assembly again die cuts strips 1 and 2 and strip 1 falls 'over-the-die' and slides down chute member 24 to rest on turn-over mechanism 27. Simultaneously, cut strip 2 falls through-the-die and down chute 39 onto end conveyor extension 17. At approximately 200 degrees rotation of the cam shaft 70, cut strip 1, positioned on the turn-over mechanisms 27, is moved because ram means 36, associated with cylinder means 35, is extended causing the turn-over plate means 30 to rotate counterclockwise such that it exceeds the vertical from the plane of the chute member 24 thereby turning over strip 1 and dropping the same onto the conveyor belt 16 of the scroll shear piler apparatus 12. Simultaneously, with this movement, the third cylinder means 65 retracts ram means 64 thereby moving the stop fingers 63 of the stop finger mechanism 62 to engage the scroll shear assembly 10 to close the path to chute member 55.

When shaft 70 has rotated to approximately 240 degrees, the scroll shear assembly again die-cuts strips 3,4 and a butt strip. Strip 3 falls over the die and again slides down chute member 24 to rest on the turn-over mechanism 27, strip 4 falls through-the-die down chute member 39 where it rests on the end conveyor extension 17 on the scroll shear piler apparatus 12 and the butt-die cut falls on the infeed side of the double set of cutting edges 11 of the scroll shear assembly to rest on the fingers 63 of the stop finger mechanism 62. At approximately 320 degrees rotation of the shaft 70, the ram means 50 of second cylinder means 51 is retracted thereby moving the trim deflector panel plate 47 from the open to the closed position wherein it blocks the passage of any trim or die-cut sheets of material from falling down chute member 39 onto conveyor extension 17. At approximately 360 degrees rotation, the cycle has been completed and the next trimming operation may be repeated.

Importantly, the above timing sequence is only approximate and serves as a point for the final timing of the apparatus because the location of the cams and proximity switches depends upon the time required for a die-cut strip to fall down a chute. This, in turn, depends on variables such as scroll shear speed, die cut strip weight, and the coefficient of friction between the die-cut sheet and the chute member. Preferably, the final adjustment of the cams with respect to the proximity switch is made such that the gap between die-cut strips is maximinzed to prevent the occurance of jams in the stacker box of the scroll shear piler apparatus.

The necessity of a turn-over mechanism 25 results because in the punching out of can ends from the die-cut strips of material, all strips must be piled with the same surface up to provide uniform and consistent can ends. Also, by positioning the trim deflector mechanism to be operative with the chute member 55, if it is desired to have the butt-die cut strip a trim cut, then the trim butt can be directed to the trim storage box.

The strip handling apparatus of the present invention permits the use of scroll shear assemblies having a double set of cutting edges to provide control over each die-cutting operation and control over the scroll shear piler thereby producing properly stacked die-cut strips of material.

I claim:

1. A strip handling apparatus for use with a scroll shear assembly having a double set of cutting edges for producing strip material from which a single row of can ends is produced, a scroll shear piler having a stacking box therein, and an infeed device, including in combination:

first chute means mounted to the out-feed side of the scroll shear assembly to direct the over-the-die cut strips of material onto the scroll shear piler for stacking in the stacking box, second chute means mounted to the scroll shear assembly between the double set of cutting edges to direct the through-the-die cut strips of material onto the scroll shear piler for stacking in the stacking box, third chute means mounted to the infeed side of the scroll shear assembly to direct the butt-die cut strips of material onto the scroll shear piler for stacking in the stacking box, and control means associated with at least two of the said first chute means, said second chute means and said third chute means to thereby predeterminely control the operation of the scroll shear assembly to permit stacking of the die cut strips of material in the stacker box.

2. The strip handling apparatus in accordance with claim 1 wherein said first chute means includes a turn-over mechanism associated therewith for turning over the over-the-die cut strips of material onto the scroll shear piler for stacking in the stacker box.

3. The strip handling apparatus in accordance with claim 2 wherein said turn-over mechanism includes cylinder means connected to plate means, pivotally attached to a shaft mounted on a frame member, said plate means being rotatable by said cylinder means from the plane of the first chute means to a position wherein said plate means exceeds the vertical from the plane of the first chute means to flip over and drop the over-the-die cut strips of material into the scroll shear piler for stacking in the stacking box.

4. A strip handling apparatus for use with a scroll shear assembly having a double set of cutting edges for producing strip material from which a single roll of can ends is produced, a scroll shear piler having a stacking box therein, and an infeed device, including in combination:

first chute means mounted to the out-feed side of the scroll shear assembly to direct the over-the-die cut strips of material onto the scroll shear piler for stacking in the stacking box, second chute means mounted to the scroll shear assembly between the double set of cutting edges to direct the through-the-die cut strips of material onto the scroll shear piler for stacking in the stacking box, said second chute means including trim deflector means attached to a deflector cylinder means, said trim deflector means being operable between a closed position wherein said trim deflector means cooperates with said second chute means to block the passage of the through-the-die cut strips of material onto the scroll shear piler and an open position wherein the through-the-die cut strips of material pass onto the scroll shear piler, and third chute means mounted to the infeed side of the scroll shear assembly to direct the butt-die cut strips of material onto the scroll shear piler for stacking in the stacking box.

5. A strip handling apparatus for use with a scroll shear assembly having a double set of cutting edges for producing strip material from which a single row of can ends is produced, a scroll shear piler having a stacking box therein, and an infeed device, including in combination:

first chute means mounted to the out-feed side of the scroll shear assembly to direct the over-the-die cut strips of material onto the scroll shear piler for stacking in the stacking box, second chute means mounted to the scroll shear assembly between the double set of cutting edges to direct the through-the-die cut strips of material onto the scroll shear piler for stacking in the stacking box, and third chute means mounted to the infeed side of the scroll shear assembly to direct the butt-side cut strips of material onto the scroll shear piler for stacking in the stacking box, said third chute means including a stop finger mechanism attached to a stop finger cylinder means, said drop finger mechanism being moveable by said stop finger cylinder means between a closed position wherein said stop finger mechanism engages the scroll shear assembly to block the passage of the butt-die cut strips of material from passage down said chute means onto the scroll shear piler and a second position wherein the stop finger mechanism is positioned away from the scroll shear assembly to permit the butt-die cut strips of material to pass down said third chute means onto the scroll shear piler for stacking in the stacking box.

6. The strip handling apparatus in accordance with claim 4 wherein said trim deflector means includes said deflector cylinder means connected to a trim deflector panel plate, pivotally attached to a shaft mounted on a frame member, said trim deflector panel plate being rotatable by said deflector cylinder means from a closed position wherein said panel plate cooperates with said second chute means to block the passage of the through-the-die cut strips of material onto the scroll shear piler and an open position wherein the through-the-die cut strips of material pass onto the scroll shear plier.

7. The strip handling apparatus in accordance with claim 1 wherein said control means includes a shaft which rotates one revolution per sheet of material passed into the scroll shear assembly, which shaft includes a plurality of predeterminely mounted cams thereon which selectively trigger proximity switches which energize and control the operation of at least two of said first chute means, said second chute means and said third chute means for stacking the die cut strips of material in the stacker box.

* * * * *